US006627261B1

(12) United States Patent
Vähäkuopus et al.

(10) Patent No.: US 6,627,261 B1
(45) Date of Patent: Sep. 30, 2003

(54) SPRAY-COATING METHOD AND SPRAY-COATER

(75) Inventors: Mika Vähäkuopus, Helsinki (FI); Vilho Nissinen, Numminen (FI); Seppo Luomi, Järvenpää (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/889,346

(22) PCT Filed: Jan. 14, 2000

(86) PCT No.: PCT/FI00/00026

§ 371 (c)(1),
(2), (4) Date: Aug. 2, 2001

(87) PCT Pub. No.: WO00/42254

PCT Pub. Date: Jul. 20, 2000

(30) Foreign Application Priority Data

Jan. 18, 1999 (FI) ..... 990091

(51) Int. Cl.[7] ..... B05D 3/02

(52) U.S. Cl. ..... 427/314; 118/62; 118/65; 118/67; 118/69; 118/DIG. 7; 427/299; 427/378; 427/422; 427/424

(58) Field of Search ..... 118/62, 65, 67, 118/69, DIG. 7; 427/299, 378, 422, 424, 314

(56) References Cited

U.S. PATENT DOCUMENTS 5,849,321 A 12/1998 Linnonmaa ..... 427/421

FOREIGN PATENT DOCUMENTS

| | | | |
|---|---|---|---|
| CA | 2238846 | 11/1998 | |
| EP | 0 881 330 A2 | 5/1998 | ..... D21H/23/50 |
| GB | 2 152 848 A | 8/1985 | ..... B05B/1/28 |
| WO | WO 9713035 | 4/1997 | ..... D21H/23/50 |
| WO | WO 98/32921 | 7/1998 | ..... D21H/23/70 |

*Primary Examiner*—Bernard Pianalto
(74) *Attorney, Agent, or Firm*—Cohen, Pontani, Lieberman & Pavane

(57) ABSTRACT

The present invention relates to a method and apparatus for coating a moving paper web (2), in which method the web (2) to be coated is passed to a coater station and the coating is applied to at least one surface of the moving web (2) by means of spraying nozzles (1) disposed in the interior of an enclosing hood (9). The web (2) is supported noncontactingly by means of air jets directed toward at least one side of the web (2).

30 Claims, 2 Drawing Sheets

SPRAY-COATING METHOD AND SPRAY-COATER

PRIORITY CLAIM

This is a national stage of PCT application No. PCT/FI00/00026, filed on Jan. 14, 2000. Priority is claimed on that application and on application No. 990091 filed in Finland on Jan. 18, 1999.

FIELD OF THE INVENTION

The present invention relates to a spray-coating method and spray-coater.

BACKGROUND OF THE INVENTION

Coating paper with a pigment slurry is performed by applying a smooth layer of coating to the surface of a paper web, after which excess water is removed from the web by means of dryers. Over the times, the application and leveling has been carried out with the help of different apparatuses, whose development has been directed by the increasing requirements toward higher quality and productivity, as well as faster web speeds in papermaking machines.

One technique suitable for use in coating a paper web is the so-called spray-coating method that is described, e.g., in the international patent application publication WO 97/13035. In the spray-coating technique the coating mix is applied to the surface of paper web by spraying nozzles in which the coating mix is atomized into small droplets prior to spraying onto the moving paper web. The coat quality can be controlled by adjusting the distance between the spraying nozzle and the web, the spray-jet velocity and the mass rate of spraying. Generally, there must be disposed a number of spraying nozzles in the cross-machine direction to the web travel, because the coverage of the spraying jet emitted by a single nozzle is usually narrower than the width of the web being coated. Typically, there is disposed a number of nozzle rows across the web, perpendicular to the web travel, since a single row of nozzles extending across the web usually fails to provide a coating of a sufficiently high quality. The coating mist not adhering to the web during the coating process can be recovered for reuse. To prevent the coating mist from escaping to the environment, the spraying nozzles are generally located in a closed space such as an enclosing hood.

After the application of the coating, the paper web must be dried in a noncontacting manner because the wet coating is sensitive to mechanical contacts. Generally, the noncontacting drying is carried out using infrared or air-impingement dryers. Cylinder dryers can be used only after the coating has attained a sufficiently low moisture content and will not any more adhere to the cylinder.

Conventionally, the coating is applied to the surface of the paper web in several steps, and the paper web may also be subjected to further drying between the successive application steps. This kind of a coater station involving a plurality of applicator/dryer devices requires a lot of space which complicates its integration with a paper machine. One of the problems to be solved in the spray-coating of paper sheet is how to apply the coating emitted from the spraying nozzles so as to attain a uniform coat weight and quality at both the center and the edges of the paper web. Usually, the applied coating layer at the edge areas of the coated paper web tend to be thinner than at the center area of the web, whereby it will be problematic to reach a smooth coat profile up to the web edges. Because the gap between the moving web and the enclosing hood is difficult to seal, it is also impossible to fully prevent the coating mist from escaping to the environment from the hood enclosing the spraying-nozzle assemblies. The spreading of the coating mist to the exterior of the enclosing hood can be reduced by using vacuum suction to remove the coating mist from the interior of the hood and then to separate the coating solids from the recovered coating mist for reuse. However, these kinds of arrangements need a separate filter for recovering coating solids from the mist. The coating mist filling the interior of the enclosing hood also tends to readily adhere to and dry on the surfaces such as the spraying nozzles housed in the interior of the hood.

SUMMARY OF THE INVENTION

It is an object of the present invention to provide a novel type of spray-application method and apparatus capable of overcoming the above-described problems.

The arrangement according to the invention replaces a roll or wire conventionally used for supporting the web by air jets directable to the surface of the web. Additionally, air jets may be used for drying the coating applied to the web surface. Furthermore, edge deckles are disposed close to the web edge between the spraying nozzles and the paper web that serve to prevent coating sprays discharged from nozzles close to the web edge from reaching the web surface at the edges. With the help of an exhaust nozzle connected to the hood enclosing the spraying nozzles, the interior of the hood is brought to a partial vacuum relative to the ambient pressure thus preventing the coating mist from escaping to the exterior of the hood. Another nozzle connected to the enclosing hood can be used for feeding air or steam into the hood in order to bring the interior temperature and humidity to a level that prevents the coating mist from depositing and drying onto the interior surfaces of the hood. Finally, the interior walls of the hood can be made coolable, whereby the coating mist will condense on the cooled surfaces.

The invention offers significant benefits.

Air jets employed in the noncontacting supporting of a paper web may replace dryer devices, whereby the dryer section may be made smaller in size and more readily integratable in the layout of the papermaking machine. With the help of the edge deckles according to the invention, the coat profile at the web edges can be made uniform and the cross-machine width of the applied coat can be easily varied. Due to the partial vacuum in the interior of the hood enclosing the nozzles, the coating mist cannot escape from the hood so as to soil equipment exterior to the hood. Furthermore, the adherence and drying of the coating onto the interior parts and surfaces of the hood is reduced thus relaxing the need for their frequent cleaning. Devices specifically intended to the separation of coating solids from the coating mist can be omitted, because of the condensation of solids from the coating mist onto the cooled interior surfaces of the enclosing hood, wherefrom the solids can be recovered for reuse in the coating mix circulation.

Other objects and features of the present invention will become apparent from the following detailed description considered in conjunction with the accompanying drawings. It is to be understood, however, that the drawings are intended solely for purposes of illustration and not as a definition of the limits of the invention, for which reference should be made to the appended claims.

BRIEF DESCRIPTION OF THE DRAWINGS

In the following, the invention will be examined in greater detail by making reference to exemplifying embodiments illustrated in the appended drawings in which like numerals delineate similar elements throughout the several views.

DETAILED DESCRIPTION OF THE PRESENTLY PREFERRED EMBODIMENTS

Figure 1:
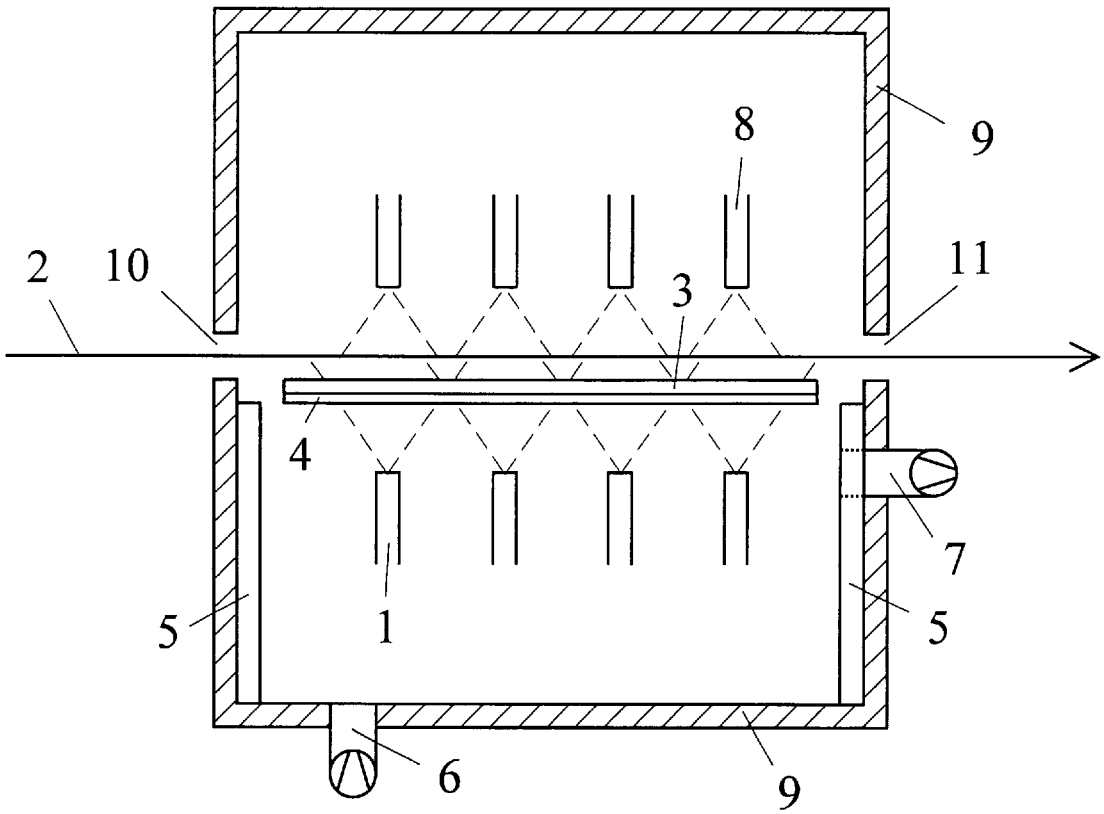
FIG. 1 shows a schematic view of an embodiment of the spray applicator apparatus according to the invention sectioned longitudinally in the travel direction of the paper web.

As shown in FIG. 1, a paper web 2 to be coated enters via a horizontal slit 10 the hood 9 enclosing the applicator apparatus. The spraying nozzles 1 are located below the web 2, while the air-jet nozzles 8 serving to support the paper web 2 are disposed above the web 2. The function of the edge deckles 3 shown in FIG. 1 are illustrated in more detail in FIG. 2. The air-jet nozzles 8 disposed above the paper web 2 inject air against the paper web 2 at an intensity sufficient to compensate for the impingement force imposed on the lower side of the web 2 by the coating jets emitted by the spraying nozzles 1 and, simultaneously, the air jets serve to dry the coating applied from the spraying nozzles 1 to the web 2. The efficiency of the drying effect can be improved by increasing the temperature of the air discharged from the nozzles 8. Via a suction nozzle 7 connected to the wall of the enclosing hood 9, the interior of the hood 9 is brought to a partial vacuum relative to the ambient pressure thus preventing the coating mist from escaping to the exterior of the hood 9. The interior walls of the hood 9 are cooled with, e.g., chilled water circulating in cooler elements 5, whereby the particulate matter of the coating mist floating in the interior of the hood 9 can be condensed on the wall surfaces and recovered therefrom to the coating mix circulation. The interior temperature and humidity of the hood 9 can be set to desired values by feeding moist air or steam into the hood 9 via an infeed nozzle 6 adapted to the bottom of the hood 9.

Figure 2:
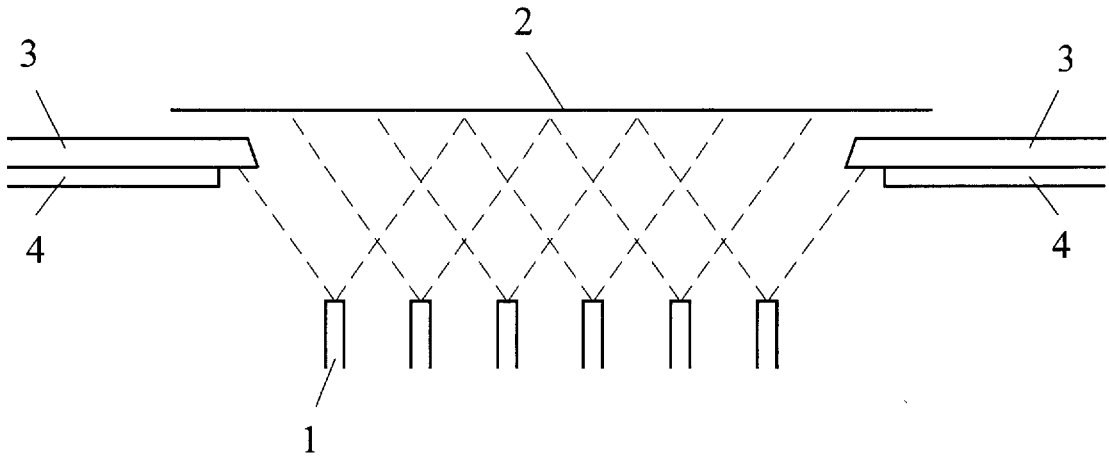
FIG. 2 shows a schematic cross-sectional view of an applicator apparatus according to the invention, particularly for edge deckles disposed between the spraying nozzles and the paper web.

In FIG. 2 are shown the spraying nozzles 1 of the applicator apparatus, the paper web 2 to be coated, edge deckles 3 and suction nozzles 4 disposed on the edge deckles 3. When the spraying nozzles 1 apply the coating to the lower surface of the paper web 2, the cross-machine width of the area being coated can be delineated with the help of the edge deckles 3 disposed between the spraying nozzles 1 and the paper web 2. Both the distance of the edge deckles 3 from the surface of the paper web 2 and the cross-machine width of the coated area delineated by the edge deckles 3 can be set to desired values. Thus, coating mist droplets accumulating on the lower surfaces of the edge deckles 3 from the coating sprays emitted by the spraying nozzles 1 can be sucked into nozzles 4 disposed on the edge deckles 3, whereby the droplets are prevented from reaching the surface of the moving paper web 2.

In addition to those described above, the invention may have alternative embodiments.

When the web support is implemented noncontactingly with the help of air jets, the enclosing hood 9 can be made long, whereby a plurality of successive or alternating applicator and dryer stages may be adapted inside the hood 9. The embodiment described above can be modified by disposing spraying nozzles 1 and air-jet nozzles 8 on different sides of the web 2. As required by the travel direction of the web 2, the enclosing hood 9 may be disposed in different positions. Thus, the hood 9 can be oriented, e.g., horizontally or vertically or even in an inclined position. The interior of the enclosing hood 9 can be equipped with deflection devices whose air discharge jets permit the travel path of the web 2 to be directed noncontactingly inside the hood 9. The air jets of the web deflection devices also make it possible to dry the coating applied to the surface of the web 2.

The boundary air layer, which travels on the surface of the moving web 2 and causes disturbance to the application of the coating to the surface of the web 2, can be removed prior to the application point, e.g., with the help of a mechanical doctoring element or by applying air jets reverse to the travel direction of the web 2. Also the exit slit 11 of the enclosing hood 9 can be sealed by air jets blowing toward the slit, reverse to the travel direction of the web 2, said air jets preventing the coating mist particles from escaping to the exterior of the enclosing hood 9 via its exit slit 11. The suction nozzles 4 connected to the edge deckles 3 may also be routed inside the edge deckles 3 or passed along the inner sides of the edge deckles 3 facing the edge of the paper web 2. The applicator apparatus according to the invention can be run with varied kinds of coating mixes. The coating to be applied to the paper web 2 may also be cooled, whereby the portion of the coating mist not adhering to the web 2 will condense more readily onto the cooled walls of the enclosing hood 9. Besides for coating paper sheet, the invention is obviously also suitable for use in the coating of board and other materials of the kind.

Thus, while there have been shown and described and pointed out fundamental novel features of the present invention as applied to a preferred embodiment thereof, it will be understood that various omissions and substitutions and changes in the form and details of the devices described and illustrated, and in their operation, and of the methods described may be made by those skilled in the art without departing from the spirit of the present invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. A method for coating a moving paper or board web comprising:

passing a web to be coated to and through a coater station;

applying a coating mix to at least one surface of the web with spraying nozzles disposed in an interior of an enclosed hood of the coater station; and supporting the web non-contactingly in the coating station with air jets directed toward at least one side of the web.

2. The method of claim 1, wherein the air jets eject heated air.

3. The method of claim 2, further comprising at least partially drying the coating mix applied to the web within the hood.

4. The method of claim 1, wherein the air jets direct air across a width of the web.

5. The method of claim 4, wherein an edge deckle is positioned between the air jets and the web along an edge of the web.

6. The method of claim 1, wherein an edge deckle is positioned between the air jets and the web along an edge of the web to collect coating mix mist droplets.

7. The method of claim 6, further comprising removing coating mix that has accumulated in the edge deckle.

8. The method of claim 1, wherein air pressure in the interior of the hood is sufficiently less than ambient air pressure outside the hood to prevent coating mix mist from escaping to an exterior of the hood.

9. The method of claim 1, further comprising feeding at least one of moist air and steam into the hood.

10. The method of claim 1, further comprising cooling walls of the hood sufficiently to cause coating mix mist in the interior of the hood to condense on the walls of the hood.

11. The method of claim 1, further comprising at least partially drying the coating mix applied to the web within the hood.

12. The method of claim 1, further comprising deflecting a travel direction of the web non-contactingly within the interior of the hood.

13. The method of claim 1, further comprising removing a boundary air layer traveling on the surface of the moving web prior to application of the coating mix to the web.

14. The method of claim 13, wherein the boundary air layer is removed with a mechanical doctoring element.

15. The method of claim 13, wherein the boundary air layer is removed by directing an air jet reverse to a travel direction of the web.

16. The method of claim 1, further comprising directing an air jet toward a slit through which the web travels to enter or leave the hood, the air jet being directed reverse to a travel direction of the web and being sufficient to prevent coating mix mist from escaping to an exterior of the hood.

17. The method of claim 1, wherein two coating mixes are applied to the web.

18. The method of claim 1, further comprising cooling the coating mix before the coating mix is applied to the web.

19. An apparatus for coating a moving paper or board web comprising:

a spraying nozzle suitable for applying a coating mix to at least one surface of the moving web;

a hood positioned to enclose said spraying nozzle while the coating mix is applied to the web; and an injection nozzle within said hood and suitable for supporting the web non-contactingly with an air jet directed toward at least one side of the web.

20. The apparatus of claim 19, further comprising an edge deckle is positioned between the spraying nozzle and the web along an edge of the web to collect coating mix mist droplets.

21. The apparatus of claim 20, wherein a position of said edge deckle between the spraying nozzle and the web is adjustable.

22. The apparatus of claim 20, wherein said edge deckle is positioned to extend at least from an edge of the web across a portion of a width of the web.

23. The apparatus of claim 22, wherein an amount of extension of said deckle across a width of the web is adjustable.

24. The apparatus of claim 21, wherein said edge deckle is positioned to extend at least from an edge of the web across a portion of a width of the web.

25. The apparatus of claim 24, wherein an amount of extension of said deckle across a width of the web is adjustable.

26. The apparatus of claim 20, further comprising a suction nozzle positioned adjacent said deckle and adapted to remove coating mix that has accumulated in said edge deckle.

27. The apparatus of claim 20, wherein said suction nozzle is connected to a side of said edge deckle facing said spraying nozzle.

28. The apparatus of claim 26, wherein said suction nozzle is connected to a side of said edge deckle facing the web.

29. The apparatus of claim 26, wherein said suction nozzle is inside said edge deckle.

30. The apparatus of claim 19, further comprising a means for deflecting a travel direction of the web non-contactingly within the interior of said hood.

* * * * *